United States Patent [19]

Ngian et al.

[11] Patent Number: 5,016,375

[45] Date of Patent: May 21, 1991

[54] LABEL CLIP FOR ELECTRICAL COMPONENT HOUSING

[75] Inventors: Jenna P. C. Ngian, New Britain; William F. Barkman, Canton, both of Conn.

[73] Assignee: Otis Elevator Company, Farmington, Conn.

[21] Appl. No.: 361,624

[22] Filed: Jun. 5, 1989

[51] Int. Cl.[5] ..... G09F 3/18

[52] U.S. Cl. ..... 40/642; 40/651

[58] Field of Search ..... 40/642, 651; 248/225.1; 211/57.1

[56] References Cited

U.S. PATENT DOCUMENTS

| | | | |
|---|---|---|---|
| 781,386 | 1/1905 | Witty | 40/651 |
| 1,761,995 | 6/1930 | Siebe | 40/651 |
| 4,713,899 | 12/1987 | Fast | 40/642 |
| 4,761,904 | 8/1988 | Fast et al. | 40/642 |
| 4,821,437 | 4/1989 | Abramson et al. | 40/642 |

FOREIGN PATENT DOCUMENTS

| | | | |
|---|---|---|---|
| 0001806 | of 1912 | United Kingdom | 40/651 |

*Primary Examiner*—Victor N. Sakran

[57] ABSTRACT

A housing (FIG. 2) for an electrical or electronic component which includes a base (10) and an enclosure cap (30), which are held together by a resilient wire-type clip (20) affixed to the base which extends along side of and then over across the top of the cap, compressively holding the cap to the base. The bottom, return leg (20AA) of the clip includes a laterally extended portion (22) at or near the front, side edge (31), from which is suspended a label holder (40; FIG. 3). An adhesively-backed label is affixed to the front display surface (43) of the holder and includes printed indicia indentifying the electrical or electronic component contained within the housing. The clip of wire-like material extends over about eighty (80%) of the width of the sides of the cap in "zig-zag" fashion and extends diagonally across the top of the cap from near one corner to near the opposing corner.

12 Claims, 1 Drawing Sheet

LABEL CLIP FOR ELECTRICAL COMPONENT HOUSING

TECHNICAL FIELD

The present invention relates to housings for electrical or electronic components, such as for example, relays, in which the housing includes a base and a removable enclosure for the component, which enclosure is held on to the base by means of a flexible clip, enclosing the electrical component. More particularly the invention relates to component identifying labels for such housings.

BACKGROUND ART

Electrical or electronic components often are housed inside of a protective housing.

One form of such a protective housing includes a base for mounting the component in a desired location, and an enclosing top or cap or other form of enclosure, which in the form of the type used in the invention usually is relatively high in its height above the base. A flexible "U" shaped clip, typically made of a flexible, somewhat resilient metal wire having its terminal ends affixed to the base, is used to hold the enclosure top to the base. The enclosure cap is often of a box-like shape having a square or rectangular configuration in its cross-section, with straight side edges, and typically is made of some form of insulating material, such as for example an appropriate, insulating, molded plastic.

Such a component housing system for an electrical relay of the type previously used in conjunction with an elevator system is illustrated in FIG. 1. In an elevator system using such an enclosed relay component, a number of them are mounted on a metal backing, usually of the order of, for example, ten to fifteen (10–15) relay components each in their separate housings. The relays typically are different from one other, varying for example in their designed voltages and types.

The wire clip 2 has substantially a "U" shape when viewed from the side, although the return legs (the upper one 2A being seen in FIG. 1) will typically have lateral undulations 2B along their lengths for enhanced holding capabilities. The return leg on the underside (which cannot be seen in FIG. 1) typically is substantially identical to, or a mirror image of, the return leg 2A, which can be seen in the figure. Typically, the distal, central portion 2C of the clip 2 also includes an undulation or peak 2D for enhancing grasping of the clip.

At each of the two proximal ends of the clip wire 2 there typically is a ninety (90°), inner bend, so that the tips (not seen) laterally extend into circular openings or holes in the base 1 into which they mate, forming attachment axes. This interfacing allows the clip 2 to rotate about the proximal ends, as well as to affix the clip to the base 1.

With respect to each enclosed relay component, when it is desired to maintain the enclosure on the base 1 and "lock" it in place, the enclosure 3 is placed in position on the base 1, and the flexible "U" shaped clip 2 is clipped over the enclosure, holding it in place under compression.

When it is desired to remove the enclosure 3, the clip 2 is merely pulled or popped off to the side, rotating about the proximal end tips, allowing the enclosure to be removed. This action provides access to the relay or other electrical or electronic component (not particularly illustrated) mounted on the base 1. When so removed, the relay mounted on or in the base 1 can be viewed and removed for, for example, replacement.

Typically, it is desired to label the component in the housing identifying it to provide guidance for, for example, maintenance workers and repair men in checking out or "trouble shooting" and repairing the electrical system, which includes such enclosed components.

However, depending on the component and the base design, there typically is no available room on the base for the label in an area which could be readily seen by the worker, and the same is typically true of the component. Even if there is room on the component for a label, when the component is removed, the identifying label then also is gone, and typically the replacement component is unlabeled. Also, one has to open the housing to view any such labeled component.

Although there usually is room for a label on the enclosure caps or top covers 3, they are typically standard in size and, when removed, can be easily mixed up with the covers from the other adjacent components. This allows then for the easy misidentification of components by the cover from one housing inadvertently being put in place of the cover on another housing and vice-versa, which housings are enclosing possibly totally different relays or other electrical components.

Thus, a need has existed for a long period of time for an appropriate labeling approach for such housings for properly identifying on a relatively permanent basis the component enclosed within each housing.

DISCLOSURE OF INVENTION

The present invention is thus directed to providing a housing system for electrical components using a wire-type clip attached to the base of the housing having a labeling subsystem for such housings for properly identifying on a relatively permanent basis the component enclosed within each housing.

It is a further object to have such a label subsystem function so that it is independent of the enclosure cap or top and is not dependent on either the exterior surfaces of the base or the component for the labeling.

The present invention achieves these objects in its preferred embodiment by including on the wire-type clip a label holder, and preferably redesigning the wire clip, so that it has a laterally extended leg from which the label holder is suspended. Even more preferably the laterally extended leg is included on the wire clip at that portion along its length which just underlies the distal, bottom portion of the enclosure clip.

The label holder preferably has a "T" shaped cross-section, with the wire extending through the top of the "T" portion and with the wire preferably being integrated with the label holder, either fixedly or in a manner which allows some rotation of the label holder about the wire.

Once the label holder is so provided, it presents a readily available, vertically aligned surface on the stem portion of the "T" shape for the identifying indicia to be displayed. Such indicia can be added to the holder by means of, for example, a separate paper label having an adhesive backing.

Both it and the label holder with its integrated clip wire can be added to the base at the time of the component and housing subassembly or added later on site, or one or more of the various elements can be added at different times along the way, from the initial mounting of the component on the base to the final installation of the housed component at the job site.

The invention may be practiced in a wide variety of applications with many different types of electrical or electronic components and many different sized housings, utilizing known technology in the light of the teachings of the invention, which are discussed in further detail hereafter.

Other features and advantages will be apparent from the specification and claims and from the accompanying drawings, which illustrate one exemplary embodiment of the invention.

BEST MODE FOR CARRYING OUT THE INVENTION

Figure 1:
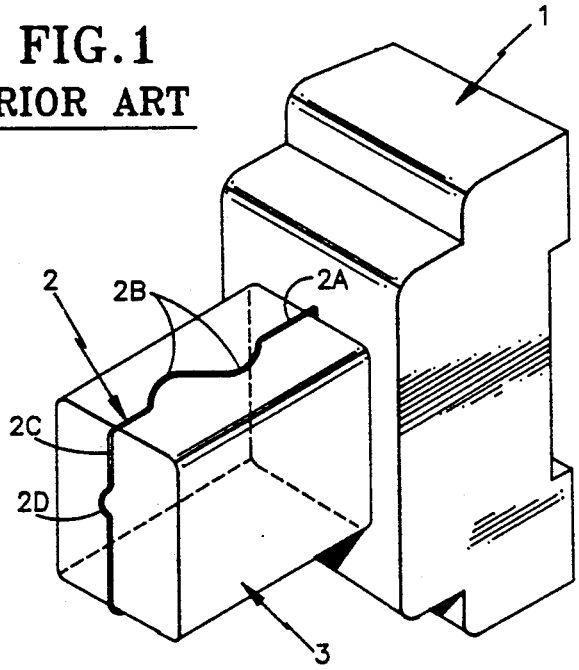
FIG. 1 PRIOR ART
FIG. 1 is a perspective view of an exemplary "prior art" housing system for an electrical component, such as for example a relay, showing the unseen edge surfaces of the enclosure cap or top in dashed lines, with the enclosure top clipped in place onto the base of the housing.
Figure 2:
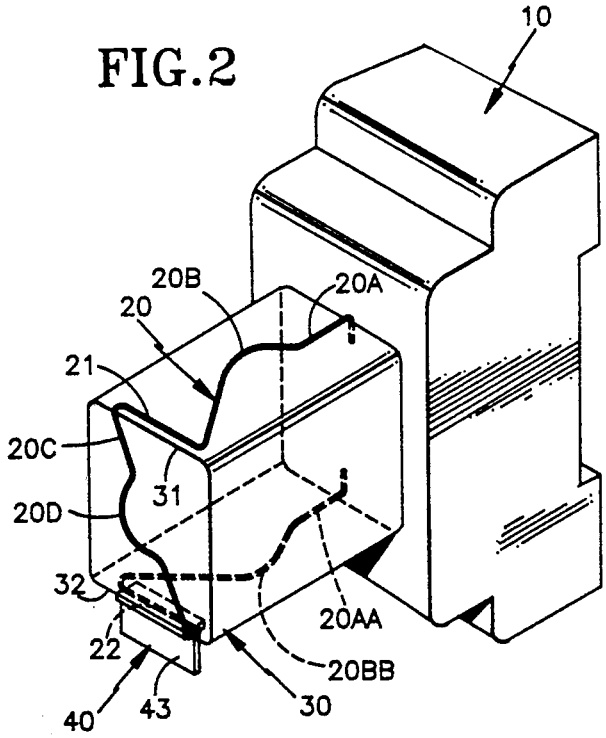
FIG. 2 is a perspective view of an exemplary housing and labeling system for the present invention with all of the parts fully assembled, with the enclosure top clipped in place onto the base of the housing, with the uniquely configured clip used in the present invention, with the unseen edge surfaces of the enclosure cap or top, as well as the clip leg on the underside of the top, being illustrated in dashed lines.
Figure 3:
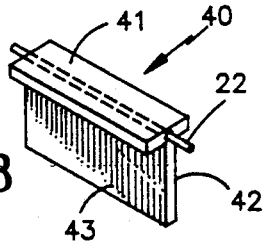
FIG. 3 is a perspective, "close-up" view of the exemplary label holder element used in exemplary embodiment of the invention illustrated in FIG. 2.

An exemplary embodiment of the invention is illustrated in FIG. 2 and includes in similar fashion to FIG. 1 a base 10, a clip wire 20 and an enclosure cap or top 30. The base 10 and the housing top 30 are substantially the same as the base 1 and the top 3 of FIG. 1.

However, the distal, central portion 20C (with its undulated portion 20D) of the clip 20 extends diagonally across the flat top of the cap 30, from near one opposed corner to near the other opposed corner, in contrast to extending orthogonally and "vertically" across the middle of the top, as did the analogous portion 2D of the "prior art" clip 2 of FIG. 1.

Additionally, the upper and lower return legs 20A & 20AA, respectively, of the clip 20 each includes a laterally extending, end portion 21 & 22, respectively, each of which end portions extends parallel along and in juxtaposition to the upper and lower end edges 31 & 32, respectively, of the cap 30. This zig-zag run provides greater holding bearing contact between the clip 20 and the enclosure cap 30 and, for the lower return leg 20AA, presents a laterally extending, bottom edge portion from which the label holder 40 can be suspended.

As can be seen in the "close-up" view of FIG. 2, the label holder forms in side, cross-section a "T" configuration, having a flat top, "horizontal" section 41 and a lower or bottom stem section 42. The frontally facing surface 43 provides a good, flat surface, to which, for example, an adhesively backed label can be applied. "Frontally" typically would refer to that side of the stem section 42 facing aWay from the base 10.

The label typically would include such identifying indicia, as, for example, the type of electrical or electronic component the housing contains, its electrical characteristics, and its model number, as well as possibly other informational items of interest.

As can be seen in FIG. 2, in comparing it to FIG. 1, the laterally extent of the return legs 20A & 20AA, particularly at the laterally extending end portions 21, 22, in comparison to the undulations 2B, provide greater holding and stability capabilities, which more reliably holds the cap 30 unto the base 10. The end portions 21 & 22 eXtend across most of the width of the cap 30, extending across a total of, for example, about eight (80%) percent of the total side width of the cap. Thus, the cap 30 will have a greater resistance against being, for example, vibrated off the base, in, for example, such high vibration systems as the modern elevator system.

The wire of the clip wire 20 extends through the attachment junction area at which the top section 41 and the stem or bottom section 42 come together. The label holder 40 can either be fixedly attached to the wire section 22, by being, for example, molded unto it (as illustrated), or it can be pivotally mounted on it by having a hole drilled through it or molded into it, through which hole the wire is slipped. An exemplary dimension for the display surface 46 is a half inch by a quarter inch ($\frac{1}{2}'' \times \frac{1}{4}''$), the size of one of the standard adhesive-backed labels.

The indicia on the label adhered, printed or otherwise applied to the display surface of the label holder 40, tells the worker exactly what component is contained within the housing. When it is desired to gain access to the housing in order to check and/or replace the component, the clip wire 20 is merely pulled or popped off to the side of the housing, with the clip being rotated about the axes provided by the inwardly directed, bent, proximal end tips, which are carried in holes in the base 10.

Although the end portion onto which the label holder 40 is suspended is preferably part of the lower, return leg 20AA of the clip 20, it is possible to include it the central portion 20C at the top of the cap 30. However, suspending it under the cap 30 better protects it from being broken off, and presenting it at the lower, front edge enhances its visibility and readability.

Although this invention has been shown and described with respect to a detailed, exemplary embodiment thereof, it should be understood by those skilled in the art that various changes in form, detail, methodology and/or approach may be made without departing from the spirit and scope of this invention.

Having thus described at least one exemplary embodiment of the invention, that which is new and desired to be secured by Letters Patent is claimed below.

We claim:

1. A two-part housing for an electrical or electronic component, including a base on which the component is carried and a removable enclosure cap which is supported on the base, and a resilient, wire-like clip attached to the base and extending along and over the cap for compressively holding the base and cap together covering over the component, wherein the clip comprises:

wire-like material having a laterally extending portion extending across a substantial amount of the width of the cap, at least a portion of said wire-like material being displaceable to allow the enclosure cap to be removed; and an indicia carrying holder suspended from said laterally extended portion and having a frontally presented surface upon which identifying indicia may be presented.

2. The electrical/electronic component housing of claim 1, wherein the cap has a top with a straight edge portion along its bottom; and said laterally extending portion of said clip extends parallel and in juxtaposition to said edge portion.

3. The electrical/electronic component housing of claim 1, wherein said label holder forms a "T" shape, including a top section and an attached bottom section, with the top section being wider than the bottom section forming the arms of the "T" shape; said wire-like material extending through the attached junction portion between said top and bottom sections; and said frontally presented, indicia carrying surface being on said bottom section.

4. The electrical/electronic component housing of claim 1, wherein the cap has a rectangular top and said wire-like clip has a central, distal portion extending across the top of the cap extending from near one corner of the rectangular cap to near an opposing corner of the rectangular cap, extending diagonally across said top.

5. The electrical/electronic component housing of claim 4, wherein said wire-like clip has two laterally extending portions, one near one straight side edge of the rectangular top and the other near the opposite straight side edge of the rectangular top.

6. The electrical/electronic component housing of claim 5, wherein the one of said laterally extending portions from which is suspended said holder is at the bottom side edge of said top.

7. The electrical/electronic component housing of claim 4, wherein said two laterally extending portions bear against the side surfaces of the cap.

8. The electrical/electronic component housing of claim 1, wherein said laterally extending portion extends across about eighty (80%) percent of the width of the cap.

9. The electrical/electronic component housing of claim 1, wherein said holder is molded onto said laterally extending portion.

10. A two-part housing for an electrical or electronic component, including:

a base on which the component is carried and a removable enclosure cap having a rectangular top and being supported on the base, the top of the cap having a straight edge portion along its bottom side and a straight edge portion along its top side, the base including a resilient, wire-like clip attached to the base and extending along the sides of and over and across the top of the cap for compressively holding the base and cap together, covering over the component, wherein the clip comprises:

a continuous piece of wire-like material having two laterally extending portions, one near one straight side edge of the rectangular top and the other near the opposite straight side edge of the rectangular top; both of said laterally extending portions extending across a substantial amount of the width of the cap; said laterally extending portions of said clip extending parallel and in juxtaposition to the side edge portions of the cap and bearing against the side surfaces of the cap; said wire-like material having a central, distal portion extending across the top of the cap extending from near one corner of the rectangular cap to near an opposing corner of the rectangular cap, extending diagonally across the top of the cap; and a rigid, indicia carrying holder suspended from one of said laterally extended portions and having a frontally presented surface upon which is carried identifying indicia, the indicia identifying the component being contained with the housing; said label holder forming a "T" shape, including a top section and an attached bottom section, with the top section being wider than the bottom section forming the arms of the "T" shape; said wire-like material extending through the attached junction portion between said top and bottom sections; and said frontally presented, indicia carrying surface being on said bottom section.

11. The electrical/electronic component housing of claim 10, wherein the one of said laterally extending portions from which is suspended said holder is at the bottom side edge of the top.

12. The electrical/electronic component housing of claim 10, wherein said laterally extending portions extends across about eighty (80%) percent of the width of the cap.

* * * * *